US009156661B1

(12) United States Patent
Kieran

(10) Patent No.: US 9,156,661 B1
(45) Date of Patent: Oct. 13, 2015

(54) GRIP DEVICE FOR HOLDING AND CARRYING A VISE

(71) Applicant: Thomas G. Kieran, Peoria, AZ (US)

(72) Inventor: Thomas G. Kieran, Peoria, AZ (US)

( * ) Notice: Subject to any disclaimer, the term of this patent is extended or adjusted under 35 U.S.C. 154(b) by 0 days.

(21) Appl. No.: 14/518,615

(22) Filed: Oct. 20, 2014

(51) Int. Cl.
*B66C 1/62* (2006.01)
*B25B 1/24* (2006.01)

(52) U.S. Cl.
CPC *B66C 1/62* (2013.01); *B25B 1/2457* (2013.01)

(58) Field of Classification Search
CPC ..... B25B 1/2457; B25B 1/2463; B65G 7/12; B66C 1/62; B66C 1/66; A45F 5/10
USPC ..... 294/15, 92, 145, 158, 165; 269/271; 16/422
See application file for complete search history.

(56) References Cited

U.S. PATENT DOCUMENTS 801,342 A * 10/1905 Schultz ..... 294/16
1,448,999 A 3/1923 Haarberg
1,893,267 A 1/1933 Bickel
2,604,352 A 8/1952 Gonser
2,967,730 A * 1/1961 Vann ..... 294/62
3,373,987 A 3/1968 Herrington
3,377,062 A 4/1968 Haselwood
5,820,180 A * 10/1998 Haupt ..... 294/16
5,921,597 A * 7/1999 Thiele ..... 294/17
6,048,009 A * 4/2000 Sorg ..... 294/15
6,170,813 B1 * 1/2001 Bowers ..... 269/282
6,386,608 B1 * 5/2002 Eister ..... 294/62
6,637,738 B1 10/2003 Beaudet
8,251,358 B2 8/2012 Grolman
2004/0245789 A1 * 12/2004 Berl et al. ..... 294/15
2011/0241366 A1 * 10/2011 Hamblin et al. ..... 294/158

* cited by examiner

*Primary Examiner* — Dean Kramer

(74) *Attorney, Agent, or Firm* — Thomas W. Galvani, P.C.; Thomas W. Galvani

(57) ABSTRACT

A device for holding and carrying a vise includes a block, a handle rigidly coupled to the block, and an engagement element on the block which is configured to be engaged by a vise so as to form an engagement assembly, which in response to the vise being clamped onto the device, prevents the block from slipping from the vise.

7 Claims, 5 Drawing Sheets

GRIP DEVICE FOR HOLDING AND CARRYING A VISE

FIELD OF THE INVENTION

The present invention relates generally to machining tools, and more particularly to tools for securing and carrying machining equipment.

BACKGROUND OF THE INVENTION

A machine shop is filled with machines for working a piece of metal into a finished product. Those machines include lathes, presses, mills, CNC machines, and the like. At many machines, the piece to be worked must be held stationary with respect to the machine, and generally, a vise is used to clamp the piece in place. Vises have been used for a long time to do so. Generally, the vise includes a pair of opposed jaws, at least one of which can be moved toward the other to clamp the piece into a stable position.

When working a piece of metal, a lubricant is often introduced to the work site to reduce heat and the risk of damage to the piece and the tool. For example, when operating a drill press to bore a hole through a piece, it may be advantageous to lubricate the work site or the drill bit with oil so that the hole is formed quickly, smoothly, and without damaging the piece or the bit. Lubricant is consumed by the machining operation but is also disbursed during work, so that it frequently covers the operator, the work piece, and the tool. Additionally, lubricant almost always drips and collects on the vise holding the piece, as the vise is usually positioned below the piece. While the piece usually may be easily cleaned once finished, the vise is more burdensome to clean. It is large, heavy, and can have many crevices, channels, threads, and other small spaces difficult to thoroughly clean. Consequently, the vise often is not cleaned, and gradually becomes dirtier and dirtier with accumulation of lubricant and metal shavings.

Some machine shops will have a vise at each machine, while others may have only one or two vises that are moved to each machine on an as-needed basis. Regardless, at some point, a vise must be moved, perhaps to better position the work piece, perhaps to switch with a larger or smaller vise, or perhaps to move to a new machine. A vise can be incredibly heavy however, and when a vise is covered in accumulated oil, it can be very slippery. Vises can be dropped, causing property damage and possibly bodily injury. Vises covered in oil thus pose a danger when being moved. Unfortunately, it can be difficult to clean these vises to make them safer to carry, because they must generally be moved or at least picked up to be cleaned, and the problem of slipperiness is still encountered. A safe, reliable way to handle and move a vise is needed.

SUMMARY OF THE INVENTION

A vise grip device for handling and moving a vise includes a base and a handle fixed to the base. The vise is clamped onto the base of the device to secure the device to the vise, and the handle is then available to be taken up by hand so that an operator may grip the handle and lift and move the vise safely.

BRIEF DESCRIPTION OF THE DRAWINGS

Referring to the drawings.

DETAILED DESCRIPTION

Figure 1:
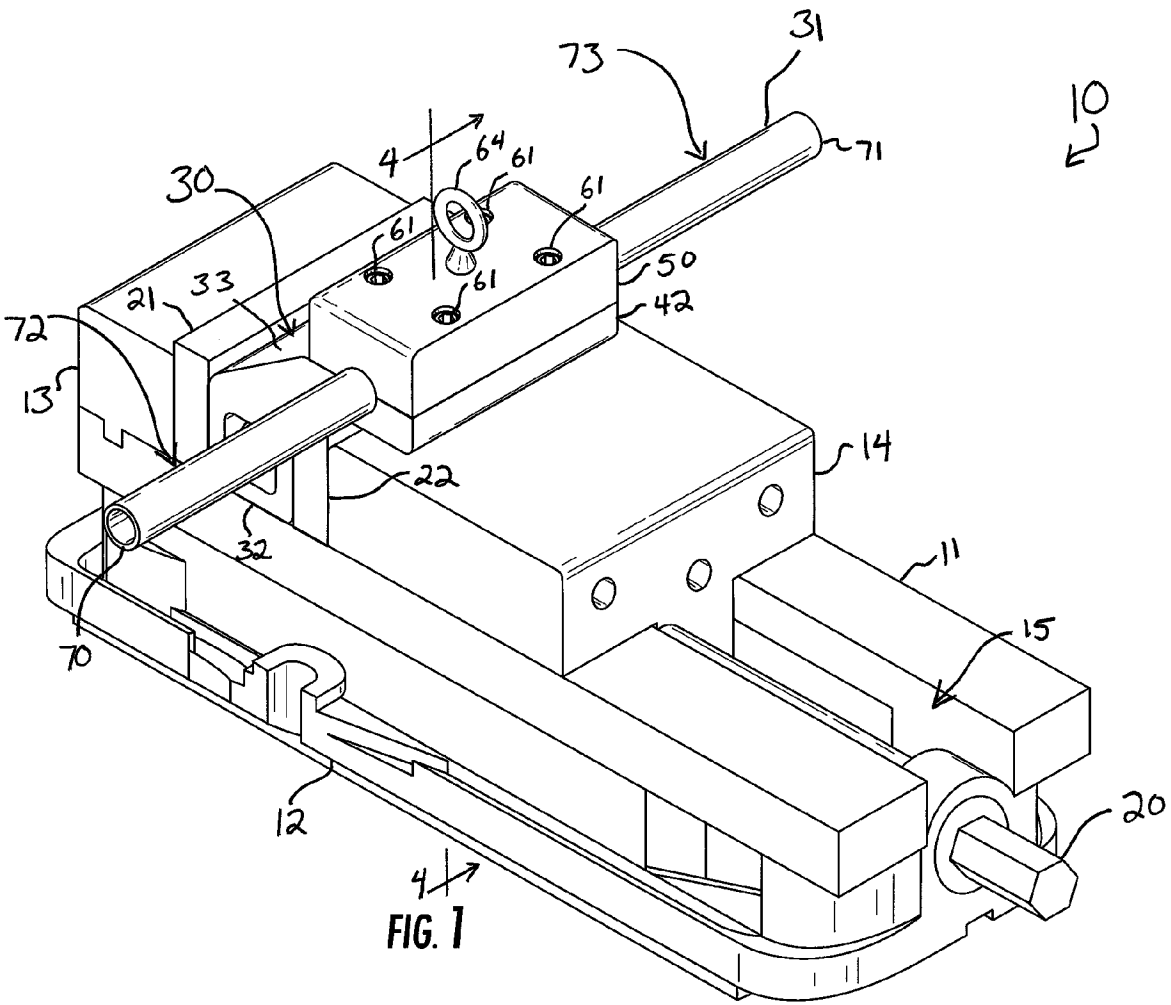
FIG. 1 is a top perspective view of a vise grip device installed in a conventional vise.

Reference now is made to the drawings, in which the same reference characters are used throughout the different figures to designate the same elements. FIG. 1 illustrates a vise grip device 10 applied to and installed in a machining vise 11. The machining vise 11 is typical of conventional machining or drill vises and includes a base or body 12 which can be secured to a machine such as a drill, a mill, a press, or other similar shop tool. The vise 11 has a fixed jaw 13 at one end of the body 12 and a movable jaw 14 mounted for reciprocal movement on a track 15 in the body 12 toward and away from the fixed jaw 13. A drive shaft 20 is operatively coupled to the movable jaw 14 to move the movable jaw 14 in response to rotation of the drive shaft 20, and a handle which is removed from the drive shaft 20 in FIG. 1 is normally coupled to the drive shaft 20 to impart rotation thereto so as to move the movable jaw 14. Two face plates 21 and 22 are secured to the fixed and movable jaws, respectively. The face plates 21 and 22 opposite and identical, each being a relatively elongate, rectangular shank of hard metal for being clamped by the vise 11 against an object to be worked.

Figure 2:
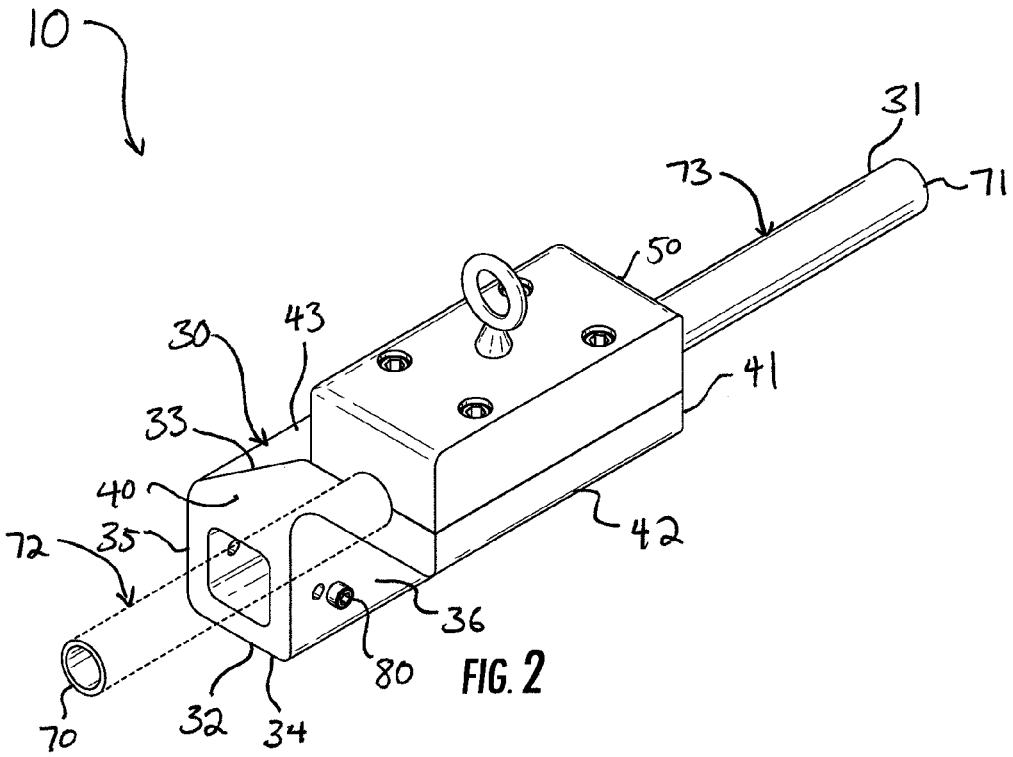
FIG. 2 is a top perspective view of the vise grip device of FIG. 1 shown in isolation.

As seen in FIG. 1, the device 10 includes a base 30 and a handle 31 rigidly coupled to the base 30. The base 30 is an integral, continuous, monolithic piece constructed from a single material or combination of materials having material characteristics or hardness, rigidity, and durability, such as steel, iron, aluminum, and other metals. The base 30 is preferably forged, extruded, or machined into shape. The base 30 includes a block 32 and a neck 33 extending upwardly from the block 32. Turning now to FIG. 2, which shows the device 10 in greater detail, the block 32 is a hollow, elongate structure having a lower face 34, a first face 35, an opposed second face 36, and the neck 33 extending upwardly from the block 32 opposite the lower face 34. The base 30 has opposed ends 40 and 41, and when viewed from the end 40 or the end 41, the block 32 and neck 33 cooperate to form an inverted, generally L-shaped profile.

The first and second faces 35 and 36 are flat and parallel with respect to each other, and generally transverse with respect to the lower face 34. The neck 33 includes a clamp pad 42 and an intermediate portion 43 extending between the clamp pad 42 and the block 32. The intermediate portion 43 is aligned obliquely with respect to the block 32, rising opposite the lower face 34 and away from the first face 35 over the second face 36, so that the clamp pad 42 is disposed over, cantilevered over, and offset from, the second face 36 of the block 32. The clamp pad 42 is parallel to the lower face 34 and forwardly offset from the second face 36.

Figure 3A:
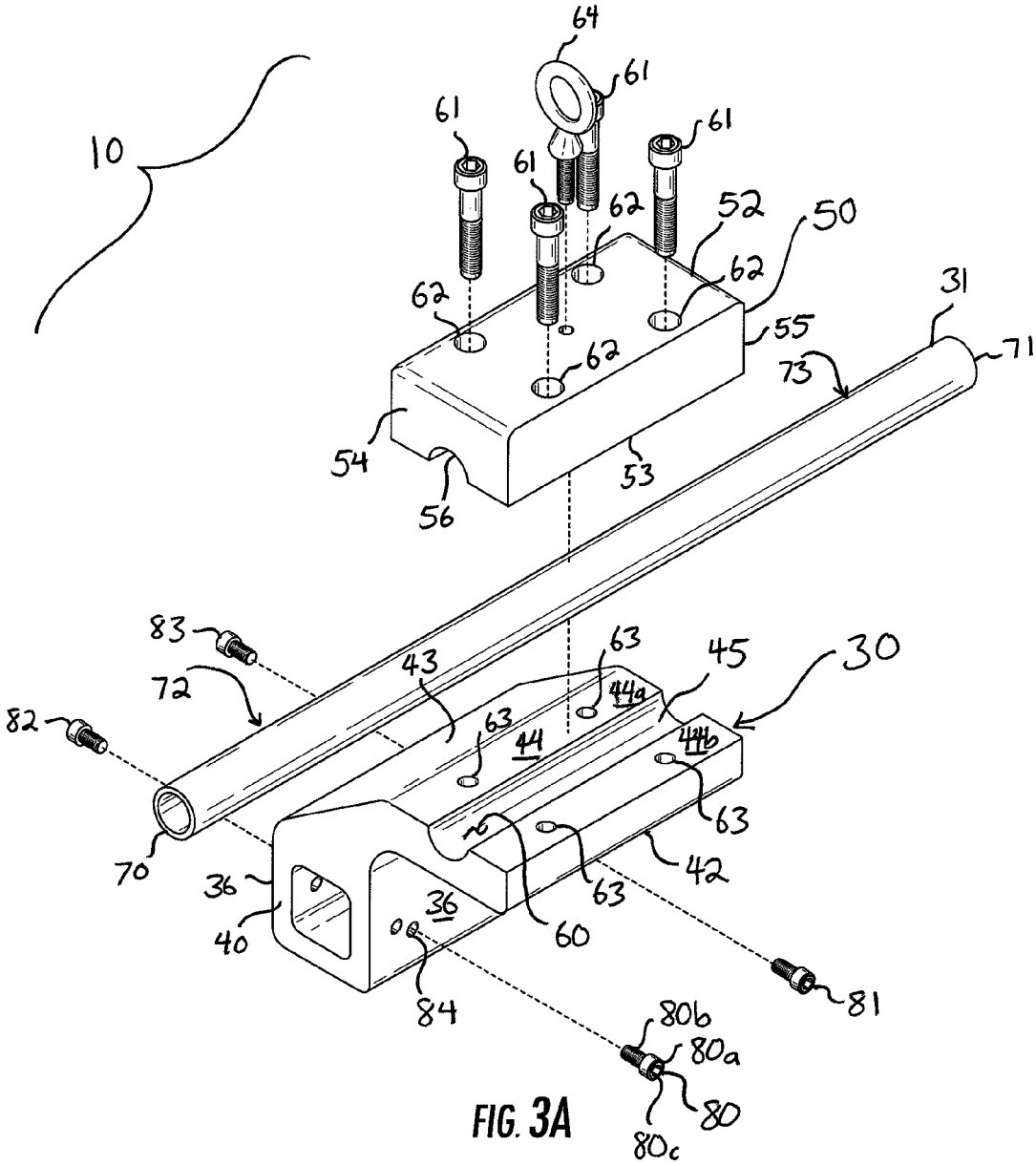
FIG. 3A is an exploded top perspective view of the vise grip device of FIG. 1.

Referring now to the top perspective view of FIG. 3A, the clamp pad 42 is shown in greater detail. The clamp pad 42 includes an upper face 44 formed with a semi-cylindrical channel 45 delineating the upper face 44 into first and second portions 44*a* and 44*b*, respectively. The first and second portions 44*a* and 44*b* are preferably generally equal in size, are flat, and are parallel and level with each other, so that they define the upper face 44 as a flat mount for a clamp top 50. The channel 45 extends from the end 40 to the end 41. The clamp pad 42 receives the clamp top 50. The clamp top 50 cooperates with the clamp pad 42 to define a clamp for rigidly holding and coupling the handle 31 to the base 30.

Figure 3B:
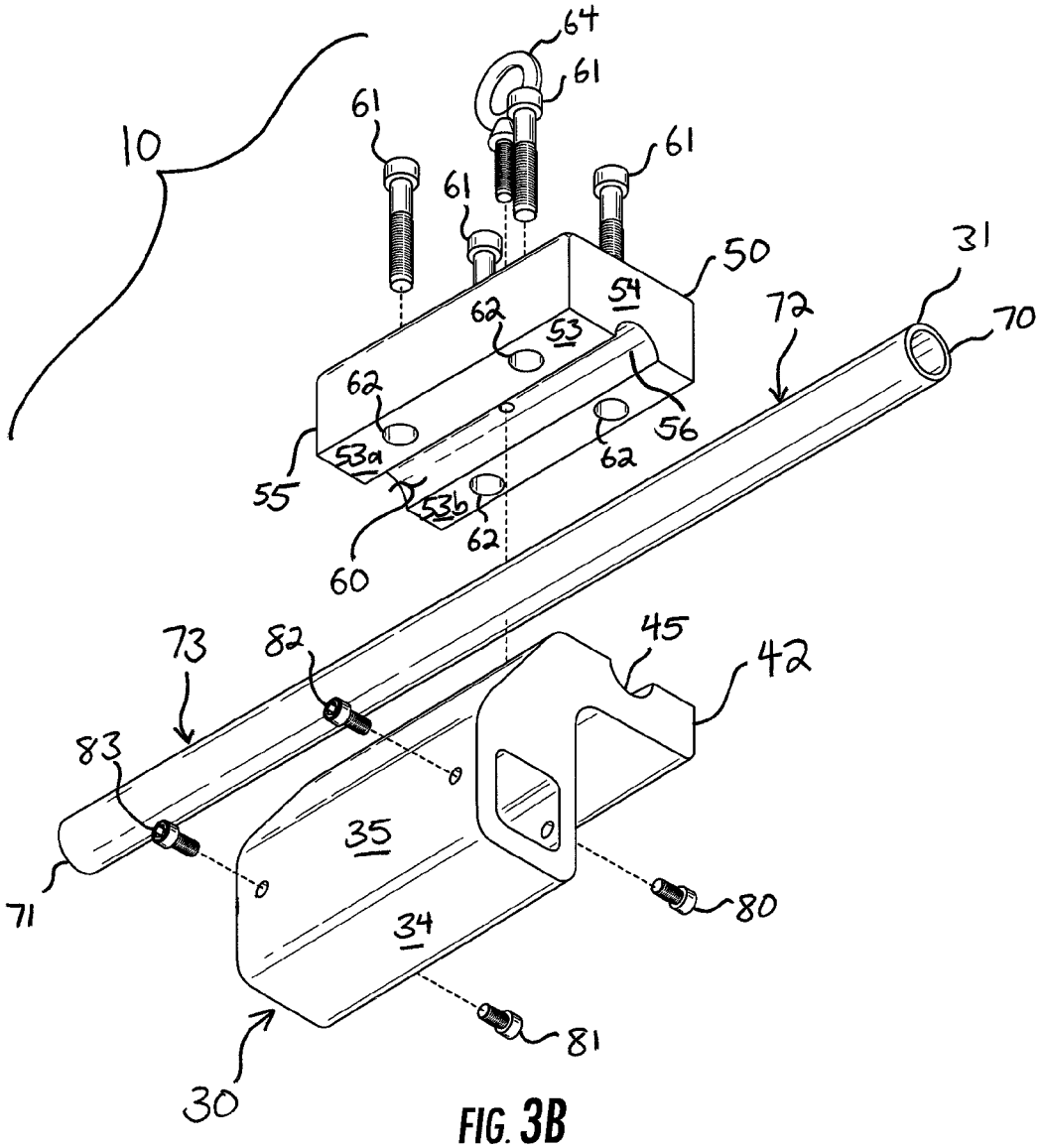
FIG. 3B is an exploded bottom perspective view of the vise grip device of FIG. 1.

The clamp top 50 is a solid block having a top 52, a lower face 53 opposed from the top 52, two opposed ends 54 and 55, and a channel 56 delineating the lower face 53. Referring now to FIG. 3B, which is a bottom perspective view of the device 10, it is seen that the channel 56 delineates the lower face 53 into a first portion 53*a* and a second portion 53*b*, which are preferably generally equal in size, are flat, and are parallel and level with each other, so that they define the lower face 53 as a flat contact face for receipt against the upper face 44 of the clamp pad 42. The first portion 53*a* on the clamp top 50 corresponds to and is coextensive with the first portion 44*a* on the clamp pad 42, and, likewise, the second portion 53*b* on the clamp top 50 corresponds to and is coextensive with the second portion 44*b* on the clamp pad 42. The channel 56 in the clamp top 50 is semi-cylindrical and is formed upwardly into the clamp top 50 from the lower face 53 between the ends 54 and 55. The channels 45 and 56, when the clamp top 50 is against the clamp pad 42, cooperate to form a cylindrical hold, identified in FIGS. 3A and 3B with the reference character 60. The hold 60 has a diameter just slightly smaller than the diameter of the cylindrical handle 31, so that when the clamp top 50 is clamped against the clamp pad 42 with the handle 31 therebetween, the handle 31 is prevented from slipping, rotating, or moving laterally in the hold 60.

Returning to FIG. 3A, four bolts 61 clamp the clamp top 50 onto the clamp pad 42. Four spaced-apart holes 62 are formed entirely through the clamp top 50 from the top 52 to the lower face 53. Briefly, referring to FIG. 3B, the holes 62 are formed through the first and second portions 53*a* and 53*b*, flanking the channel 56. Referring back to FIG. 3A, four corresponding threaded blind bores 63 are formed in the clamp pad 42, extending downwardly from the upper face 44. The bores 63 are formed in the first and second portions 44*a* and 44*b*, flanking the channel 45. The holes 62 align with the bores 63. The bolts 61 have enlarged heads and partially-threaded shanks, which threadably engage with the bores 63 in the clamp pad 42. The holes 62 are formed with seats, so that upper portions of the holes 62 have a larger diameter to receive the enlarged heads of the bolts 61, and opposed lower portions of the holes 62 have a smaller diameter to receive the narrower shanks of the bolts 61. An eye bolt 64 is preferably threaded into the clamp top 50 at a geometric center of the clamp top 50.

Referring still to FIG. 3A, the handle 31 is a long cylindrical, hollow pipe having opposed ends 70 and 71. The handle 31 is lightweight and constructed from a material or combination of materials having the characteristics of light weight, hardness, rigidity, and durability. The ends 70 and 71 of the handle 31 extend well beyond the ends 40 and 41 of the base 30, as best shown in FIG. 2, such that opposed grip areas 72 and 73 are defined between end 40 and end 71, and between end 41 and end 72, respectively. Grip areas 72 and 73 provide locations at which a user can grab the device 10 to effectively carry and move the device 10. The handle 31 is aligned parallel to the block 32, such that the grip areas 72 and 73 flank the block 32. The handle 31 is forwardly offset from the block 32, and the second face 36 of the block 32, as the handle 31 is disposed forwardly from the block 32.

A user grabs the device 10 at the grip areas 72 and 73 so as to move the device 10 when the device 10 is engaged with the vise 11. In operation, a user will place the device 10 into the vise 11 to clamp the vise 11 onto the device 10. The device 10 has structure to prevent the vise 11 from slipping out of the device 10, as the vise 11 may be covered in oil and be very slippery. With reference to FIG. 2, a bolt 80 is set into the second face 36. The bolt 80 defines a protrusion on the second face 36 which extends outwardly from the second face 36. As seen in FIG. 3A, four bolts 80, 81, 82, and 83 are set into the block 32, each defining a protrusion. The bolts 80 and 81 are protrusions spaced apart and formed on the block 32 extending outwardly from the second face 36, and the bolts 82 and 83 are protrusions spaced apart and formed on the block 32 extending outwardly from the first face 35. The bolts 80, 81, 82, and 83 are identical, and, as such, only the bolt 80 will be described, with the understanding that the ensuing description applies equally to the bolts 81, 82, and 83 as well.

Still referring to FIG. 3A, the bolt 80 has an enlarged head 80*a* and a threaded shank 80*b*. The head 80*a* has a socket 80*c* for receiving an allen wrench. The bolt 80 is threadably engaged in a hole 84 formed through the second face 36 of the block 32. The hole 84 is threaded to receive and secure the bolt 80. The bolt 80 is generally kept threaded into the hole 84, so that the head 80*a* is seated against the second face 36 of the block 32 and protrudes outwardly from the second face 36. In this way, the bolt 80 is fixed to the block 32. Each of the bolts 81, 82, and 83 are similarly fixed to the block 32 in respective holes.

Figure 4:
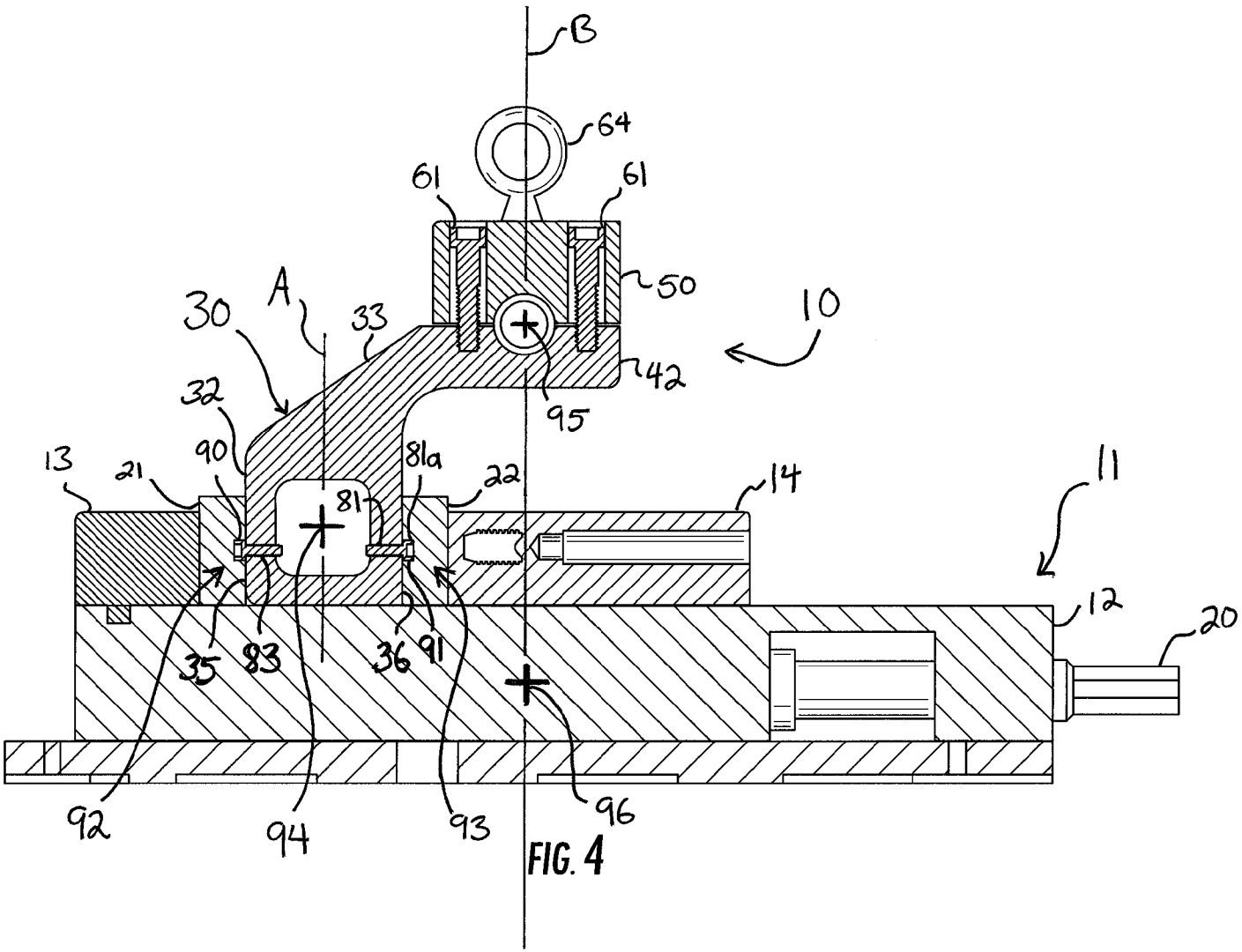
FIG. 4 is a section view taken along the line 4-4 in FIG. 1, showing the vise grip device of FIG. 1 installed in the vise.

The bolts 80, 81, 82, and 83 define engagement elements for engaging with the vise 11. Turning now to FIG. 4, which is a section view taken along the line 4-4 in FIG. 1, the device 10 is shown seated securely in the vise 11. The moveable jaw 14 is moved into a clamped position, and the base 30 is secured between the face plates 21 and 22. The face plates 21 and 22 each have a pair of holes 90 and 91, respectively, which receive the heads of the bolts 80, 81, 82, and 83. The holes 90 and 91 are formed into the base plates 21 and 22 on the inner sides of the base plates 21 and 22, directed inwardly facing the device 10. The holes 90 and 91 are engagement elements complemental to the engagement elements of the heads of the bolts 80, 81, 82, and 83, and together with those bolts 80, 81, 82, and 83, form engagement assemblies, of which two are shown in FIG. 4 and marked with the reference characters 92 and 93. The engagement assemblies 92 and 93, as well as the two unmarked engagement assemblies not shown in this section view, prevent lateral and vertical movement of the device 10 relative to the vise 11. Engagement assemblies 92 and 93 are formed in response to the movable jaw 14 clamping the block 32 between the fixed and movable jaws 13 and 14 with the bolts 81 and 83 (as shown in FIG. 4) aligned with the holes 90 and 91. Interaction, for example, of the head 81*a* of the bolt 81 against the hole 91 prevents the device 10 from moving with respect to the vise 11. Thus, when the face plates 21 and 22 are tightly clamped against the first and second faces 35 and 36, such that the bolts 80, 81, 82, and 83 are closely and snugly received in the holes 90 and 91, the device 10 is engaged with the vise 11, and the device 10 and vise 11 can be moved together as a single unit, simply by grabbing the handle 31 and lifting.

The device is arranged so that the center of gravity of the combination of the device 10 and the vise 11 is disposed generally in line with the handle 11, so that the vise does not rotate once the user has lifted the handle 31. The block 32 has a large mass, such that most of the weight of the base 30 is in the block 32. The block 32 additionally has a center of gravity, and a centroid—or geometric center—to which the center of gravity is proximate and which is identified with a cross-shaped marker and the reference character 94. Likewise, the handle 31 has a center of gravity, but has a light mass, and the handle 31 has a centroid to which its center of gravity is proximate and which is identified with a cross-shaped marker and the reference character 95. The mass of the block 32 is significantly greater than the mass of the handle. The block 32 and the handle 31 have a combined center of gravity generally disposed along the line A in FIG. 4. This combined center of gravity along line A, disposed over and aligned with the block 32, allows the device 10 to stand vertically when not applied to a vise 11, such that the device 10 can stand free with the handle 31 at an elevated position and without tipping over.

The vise 11 has an incredibly large mass, much larger than that of the handle 31 or the block 32. The vise 11 also has a center of gravity, and a centroid to which its center of gravity is proximate and which is identified with a cross-shaped marker and the reference character 96. The mass of the vise 11 is so much greater than the mass of the device 10 that the center of gravity of the entire combination of the device 10 carrying the vise 11 is located substantially proximate to the center of gravity of the vise 11. The center of gravity of this combination is marked with a line B, which extends through both of the centroids 95 and 96. Thus, the handle 31 is disposed along line B which extends through the centroid 96, and the handle 31 is disposed generally over the center of gravity of the entire combination of the device 10 and the vise 11. In this way, when the user lifts the combination of the device 10 and the vise 11, the combination of the device 10 and the vise 11 does not rotate or spin, and the user can carefully and safely lift, carry, and place the combination of the device 10 and the vise 11. Alternatively, for extremely heavy vises 10, the eye bolt 64 can be coupled to a hoist or lift to pick up the vise 10 and device 11 with mechanical assistance.

A preferred embodiment is fully and clearly described above so as to enable one having skill in the art to understand, make, and use the same. Those skilled in the art will recognize that modifications may be made to the described embodiment without departing from the spirit of the invention. To the extent that such modifications do not depart from the spirit of the invention, they are intended to be included within the scope thereof.

The invention claimed is:

1. A device for engaging with a vise, the device comprising:
a block;
a handle rigidly coupled to the block; and
an engagement element on the block;
wherein the engagement element on the block cooperates with a complemental engagement element on the vise to form an engagement assembly preventing the block from slipping out of engagement with the vise.

2. The device of claim 1, wherein the handle is above the block.

3. The device of claim 2, wherein the handle is forwardly offset from the block.

4. The handle of claim 3, wherein the handle is parallel to the block.

5. The device of claim 1, wherein the engagement element is a protrusion formed on the block.

6. The device of claim 1, wherein the engagement element includes a set of protrusions formed on a side of the block, the protrusions being sized to be closely received in holes in the vise.

7. The device of claim 1, further comprising opposed grip areas on the handle flanking the block.

* * * * *